US006041743A

United States Patent [19]

Takubo et al.

[11] Patent Number: 6,041,743

[45] Date of Patent: Mar. 28, 2000

[54] WATER-TUBE BOILER AND BURNER

[75] Inventors: Noboru Takubo; Kanta Kondou, both of Matsuyama, Japan

[73] Assignees: Miura Co., Ltd.; Miura Institute of Research & Developement Co., Ltd., both of Ehime-ken, Japan

[21] Appl. No.: 08/997,853

[22] Filed: Dec. 24, 1997

[30] Foreign Application Priority Data

Sep. 30, 1997 [JP] Japan ..... 9-284347

[51] Int. Cl.[7] ..... F22B 23/04; F23C 1/08

[52] U.S. Cl. ..... 122/367.3; 122/337; 122/343; 110/262; 431/284

[58] Field of Search ..... 122/337–338, 122/343–367.1, 367.2, 367.3; 110/262; 431/187, 278, 281, 284

[56] References Cited

U.S. PATENT DOCUMENTS 4,412,808 11/1983 Sheppard .
4,441,879 4/1984 Wagner et al. .
4,453,496 6/1984 Yoshinari .
4,825,813 5/1989 Yoshinari et al. .
5,020,479 6/1991 Suesada et al. .
5,199,384 4/1993 Kayahara et al. .
5,273,001 12/1993 Kayahara et al. .
5,353,748 10/1994 Kayahara et al. .
5,511,970 4/1996 Irwin et al. .

FOREIGN PATENT DOCUMENTS 60-78247 5/1985 Japan .

*Primary Examiner*—John A. Jeffery
*Assistant Examiner*—Gregory A. Wilson

[57] ABSTRACT

The invention provides a water-tube boiler and a burner capable of realizing a reduction in $NO_x$ and CO in both the combustion of liquid fuel and the combustion of gaseous fuel. The water-tube boiler comprises a burner which uses liquid fuel or gaseous fuel switchably, characterized in that a plurality of water tubes are arranged into an annular shape in a zone where burning-reaction ongoing gas derived from the burner is present within a combustion chamber. The water-tube boiler comprises a burner which uses either liquid fuel or gaseous fuel. A first water tube array is formed by arranging a plurality of water tubes into an annular shape in a zone where burning-reaction ongoing gas derived from the burner is present within a combustion chamber. Gaps are provided between adjacent water tubes of the first ongoing gas to flow therethrough. A zone is provided around the first water tube array to allow burning reaction to be continuously effected.

20 Claims, 4 Drawing Sheets

WATER-TUBE BOILER AND BURNER

BACKGROUND OF THE INVENTION

The present invention relates to water-tube boilers such as once-through boilers, natural circulation water-tube boilers, and forced circulation water-tube boilers, as well as to burners used in these boilers.

The water-tube boiler has a body made up by water tubes. For example, the water tubes are arranged into an annular shape. In the water-tube boiler of this form, a cylindrical space defined by the annular water tube array is used as a combustion chamber. In such a water-tube boiler, primarily radiant heat transfer occurs within the combustion chamber, and then convective heat transfer occurs downstream of the combustion chamber.

In recent years, a reduction of $NO_x$ and CO emission from such water-tube boilers has been sought. The reduction in $NO_x$, conventionally, is implemented by fitting low-$NO_x$ burners or exhaust-gas re-circulation equipment in existing boiler bodies. The reduction in CO is implemented by adjusting the state of combustion of the burner.

SUMMARY OF THE INVENTION

An object of the present invention is to achieve reduction in both $NO_x$and CO emissions in the combustion of both liquid and gaseous fuel.

In order to reduce $NO_x$ emissions according to the present invention, a water-tube boiler is provided comprising a burner which uses either liquid fuel or gaseous fuel. The water-tube boiler includes characterized in that a plurality of water tubes that are arranged into an annular shape in a zone where burning-reaction ongoing gas derived from the burner is present within a combustion chamber.

In order to further reduce $NO_x$ emissions and also reduce CO emissions at the same time, a water-tube boiler is provided comprising a burner which uses either liquid fuel or gaseous fuel. The water-tube boiler includes a first water tube array formed by arranging a plurality of water tubes into an annular shape in a zone where burning-reaction ongoing gas flow therethrough. Also, a zone is provided around the first water tube array to allow burning reaction to be continuously effected.

In particular, the burner is a diffusion-combustion burner.

Further, according to the present invention, a burner is provided which uses either liquid or gaseous fuel. The burner includes a gaseous-fuel feed pipe having a flow path with a generally annular-shaped cross section, as well as a cylindrical air resister arranged coaxially around a liquid-fuel nozzle pipe. A first air flow path is formed between the nozzle pipe and the gaseous-fuel feed pipe. A second air flow path is formed between the gaseous-fuel feed pipe and the air resister. A first baffle plate is provided at an end of the first air flow path. A second baffle plate is provided at an end of the second air flow path. Finally, a taper portion is provided at an end of the air resister. The second baffle plate is disposed at a midpoint of the taper portion. Also, an outer nozzle for spouting gaseous fuel outward and an inner nozzle for spouting gaseous fuel inward and an inner nozzle for spouting gaseous fuel inward are provided at an end portion of the gaseous-fuel feed pipe.

Also according to the present invention, the burner is used in the water-tube boilers as defined above.

The present invention is embodied both as a water-tube boiler of the multiple-tube type and as a burner for use in this type of water-tube boiler. Further, the water-tube boiler of the present invention is applied not only as steam boilers or hot water boilers, but also as heat medium boilers in which a head medium is heated.

Referring first the invention for reducing $NO_x$ emissions, the water-tube boiler as described in the first aspect of the invention comprises a burner which uses either liquid or gaseous fuel. In the water-tube boiler, a plurality of water tubes are arranged into an annular shape in a zone where burning-reaction ongoing gas is present within a combustion chamber (hereinafter, referred to as "burning reaction zone"). The combustion chamber is formed so that part or all of its interior serves as a space for the burning reaction. The space is defined by water tube arrays in one case or by exterior walls formed of refractory materials in another case. The burning-reaction ongoing gas refers to a high-temperature gas formed by the burning reaction taking place in the combustion chamber. The burning reaction zone is preferably a zone where a flame is maintained in the burning-reaction ongoing gas or a zone where a high-temperature (i.e., above 900° C.) burning-reaction ongoing gas is present. The flame herein referred to is a phenomenon that occurs while the burning-reaction ongoing gas is in the course of a vigorous burning reaction. This flame may be visually discernable in some cases, difficult to visually discern, or impossible to visually discern in other cases.

Therefore, in the water-tube boiler according to the first aspect of the invention, the burning-reaction ongoing gas is cooled by the plurality of water tubes in the burning reaction zone, so that the temperature thereof is lowered. Therefore, the generation of thermal $NO_x$ is suppressed. The reason for this suppression is that, as explained in the Zeldovich mechanism, the higher the temperature of burning reaction, the more the generation rate of thermal $NO_x$ is accelerated with its generation amount increasing; that is, the lower the temperature of burning reaction, the lower the generation rate of thermal $NO_x$ is decelerated with its generation amount decreasing. Especially when the temperature of burning reaction is less than 1400° C., the generation rate of the thermal $NO_x$ is remarkably retarded. Then, according to the first aspect of the invention, in which a plurality of water tubes are arranged into an annular shape, because the burning-reaction ongoing gas performs heat transfer upon contact with the individual water tubes, thermal load can be generally uniformed. Further, because the burning-reaction ongoing gas is cooled by the individual water tubes, the reduction of $NO_x$ emissions occurs generally uniformly on the entire circumference of the annular water tube array.

Also, the annular arrangement may be such that the plurality of water tubes may be arranged into a circular shape, or into an elliptical shape. In addition, the plurality of water tubes may be arranged into triangular, quadrangular or higher polygonal shapes. Furthermore, for the arrangement of the plurality of water tubes into an annular shape, the water tubes may be arranged in such a way that the lines connecting center to center of the water tubes form projections and recesses (i.e., the water tubes may be radially offset from each other).

In the first aspect of the invention, gaps are provided which permit the burning-reaction ongoing gas to flow between adjacent water tubes. each of these gaps has such a width that the burning-reaction ongoing gas passing through these gaps will keep burning even if cooled by the water tubes, where the width needs to be at least 1 mm.

In the first aspect of the invention, heat-recovery water tubes are arranged radially outside of the water tubes arranged into an annular shape. These heat-recovery water tubes further recover heat from the burning-reaction ongoing gas that has passed through the gaps between the water tubes, as well as from the gas that has completed the burning reaction (hereinafter, referred to as "burning-reaction completed gas"), so that the efficiency of the water-tube boiler is enhanced.

Referring next to the invention for simultaneously reducing $NO_x$ and CO emissions, the water-tube boiler as described in the second aspect of the invention comprises a burner which uses either liquid or gaseous fuel. A first water tube array is formed by arranging a plurality of water tubes into an annular shape in a zone (hereinafter, referred to as "combustion reaction zone," as in the foregoing case) where burning-reaction ongoing gas derived from the burner is present within a combustion chamber. Gaps are provided between adjacent water tubes of the first water tube array to permit the burning-reaction ongoing gas to flow therethrough. The combustion chamber, the combustion-reaction ongoing gas and the combustion reaction zone herein have the same meanings as described above for the first aspect, while the case is the same also with the flame.

In the second aspect of the invention, the burning-reaction ongoing gas is cooled by the plurality of water tubes so that the temperature thereof is lowered, so the generation of thermal $NO_x$ is suppressed. During this process, the burning-reaction ongoing gas flows through the gaps between the water tubes, so that the $NO_x$ reduction effect due to the cooling is enhanced. This is because of the Zeldovich mechanism. As has been described for the first aspect. Then, in the second aspect of the invention, a zone is provided around the first water tube array to allow burning reaction to be continuously effected (hereinafter, referred to as "burning-reaction continuing zone"). This burning reaction continuing zone is a zone where, after the burning reaction takes place inside the first water tube array, intermediate products of the burning reaction (such as CO, HC, as well as unburnt components of the fuel) are subjected to the burning reaction. The burning-reaction ongoing gas flows into this burning reaction continuing zone through the gaps between. Because CO remaining in the burning-reaction ongoing gas is oxidized into $O_2$ after entering the burning-reaction continuing zone, the amount of CO discharged from the water-tube boiler is lessened. Then, because heat transfer occurs when the burning-reaction ongoing gas contacts the individual water tubes, the thermal load can be made generally uniform. Further, because the burning-reaction ongoing gas is cooled by the individual water tubes, the reduction of $NO_x$ emissions is also generally uniform over the entire circumference of the first water tube array. In this case, the annular arrangement of the plurality of water tubes may be circular, elliptical, polygonal shapes, as described for the first aspect. Moreover, the arrangement may be such that the lines connecting centers of adjacent water tubes form projections and recesses (i.e., the adjacent water tubes are radially offset from one another).

In the second aspect of the invention, in which gaps are provided between adjacent water tubes so as to permit the burning-reaction ongoing gas to flow therethrough, each of these gaps has such a width that the burning-reaction ongoing gas passing through these gaps will keep burning, even if cooled by the water tubes, so the width needs to be at least 1 mm. Then, the gaps do not need to be formed between each pair of adjacent water tubes. Instead, for example, the plurality of water tubes may be arranged so that a specified number of water tubes are gathered in close contact, with gaps are provided between one group of such closely gathered water tubes and another. Further, the gaps do not need to be all of the same width, but the plurality of water tubes may be arranged into annular shape so that both wider gaps and narrower gaps are provided.

In the second aspect of the invention, another plurality of heat-recovery water tubes are arranged outside the first water tube array, and this plurality of heat-recovery water tubes is also arranged into an annular shape to form a second water tube array. Within the burning-reaction continuing zone located outside the first water tube array, the burning-reaction ongoing gas generates heat due to the continued reaction, including the oxidation reaction of CO as well as the reaction of intermediate products of the burning reaction and unburnt components of the fuel. Therefore, heat is recovered from the burning-reaction ongoing gas and the burning-reaction completed gas, including the aforementioned heat, by the heat-recovery water tubes. As a result, effective use of heat can be made by the heat-recovery water tubes, so that the thermal efficiency is enhanced. Then, by arranging the second water tube array into an annular shape, the heat-recovery water tubes make generally uniform contact with the burning-reaction completed gas, so that heat transfer from those gases occurs generally uniformly.

In the aforementioned water-tube boiler, the plurality of water tubes are arranged within the combustion chamber so that temperature of the burning-reaction ongoing gas after making contact with the water tubes will be below 1400° C. With this arrangement, the temperature of the burning-reaction ongoing gas is lowered so that the generation of thermal $NO_x$ is reduced. Therefore, the reduction of $NO_x$ emissions from the water-tube boiler can be achieved.

The invention as described in the third aspect is a water tube boiler provided with a diffusion-combustion burner. Diffused combustion is effected in the space defined inside the annularly arranged water tubes, so that successful combustion is maintained. Especially in the combustion of liquid fuel, a remarkable effect is produced.

The invention as described in the fourth aspect relates to a diffused-combustion burner which uses either liquid or gaseous fuel. In this burner, a gaseous-fuel feed pipe having a generally annular-shaped cross section flow path as well as a cylindrical air resister are arranged coaxially around a liquid-fuel nozzle pipe. A first air flow path is formed between the nozzle pipe and the gaseous-fuel feed pipe, and primary air flows through this first air flow path. A second air flow path is formed between the gaseous-fuel feed pipe and the air resister, and secondary air flows through this second air flow path. A first baffle plate is provided at an end of the first air flow path, and a second baffle plate is provided at an end of the second air flow path, both baffle plates serving to retain the flame. A taper portion is formed at an end of the air resister, so that the flow of the secondary air is directed toward the center of the burner. As a result, the mixing of the secondary air and the fuel is facilitated, thus making it possible to realize a reduction in the CO emissions.

The invention as described in the firth aspect is a burner in which the second baffle plate is disposed on a midpoint of the taper portion. With this arrangement, the distance between the second baffle plate and the burner end is minimized to reduce the residence time of burning-reaction ongoing gas downstream of the second baffle plate, thereby preventing the gas temperature from increasing from the radiant heat from the flame. As a result of this, an increase in the flame temperature is prevented, thus making it possible to reduce $NO_x$ emissions.

The invention as described in the sixth aspect is a burner in which an outer nozzle for spouting gaseous fuel outward and an inner nozzle for spout gaseous fuel inward are provided at an end portion of the gaseous-fuel feed pipe. The gaseous fuel spouted for the inner nozzle mixes with primary air to form a small flame at a position downstream of the first baffle plate. This small flame serves as a pilot flame, improving the stability of the flame.

The invention as describe din the seventh aspect is a water-tube oiler including a burner as described above in the first aspect of the second aspect. In both the combustion of liquid fuel and the combustion of gaseous fuel, further reduction of both $NO_x$ and CO emissions can be achieved by the combination of the boiler arrangement hat realizes the reduction in both $NO_x$ and CO emissions and the aforementioned boiler.

DETAILED DESCRIPTION OF THE PREFERRED EMBODIMENTS

Figure 1:
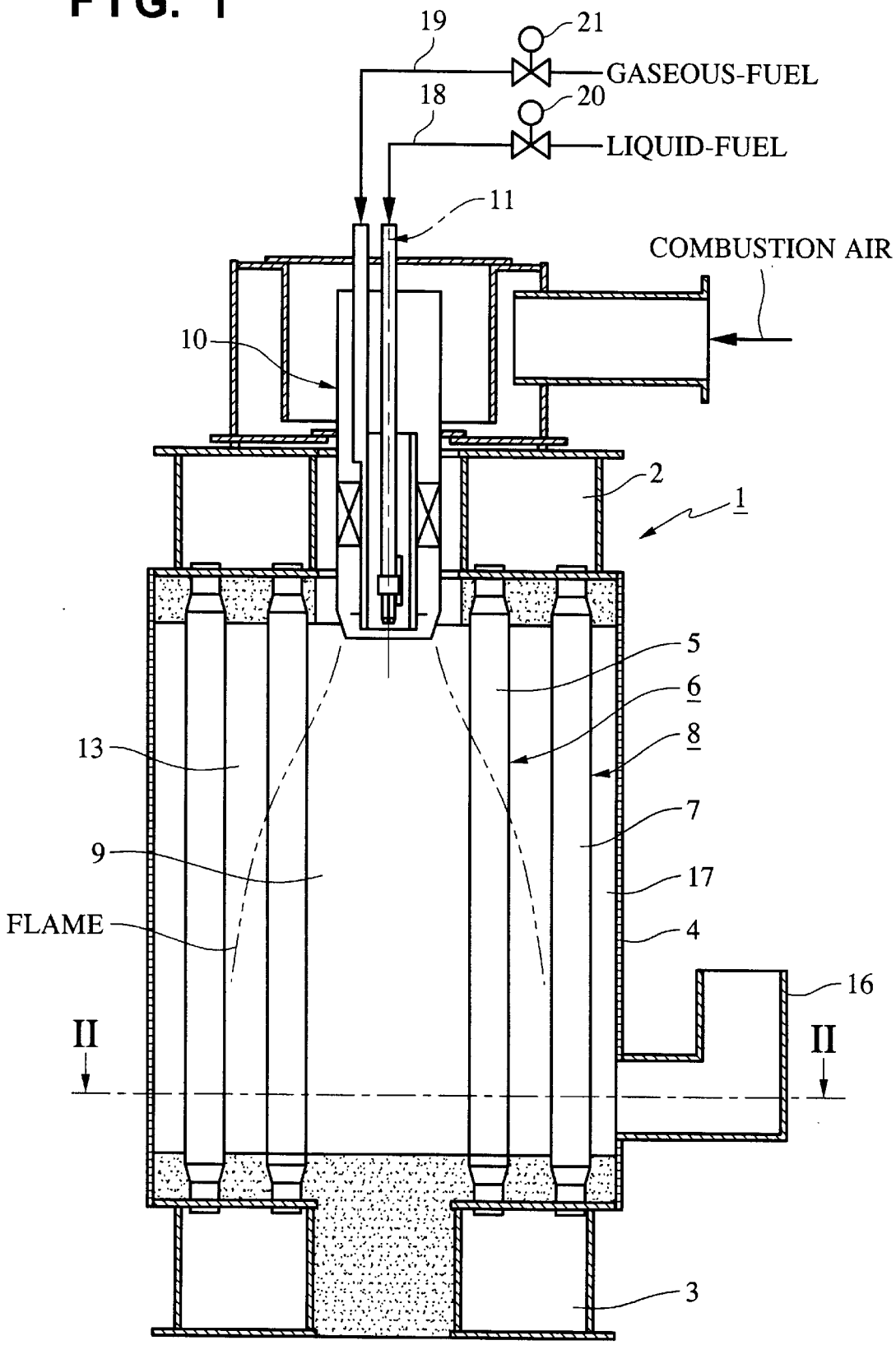
FIG. 1 is a vertical cross section of an embodiment of the water tube boiler according to the present invention.

Hereinbelow, an embodiment in which the present invention is used in a multiple-tube type once-through boiler is described with reference to FIGS. 1 and 2. FIG. 1 is a vertical cross section of the boiler according to the present invention, and FIG. 2 is a cross section taken along the line II—II of FIG. 1.

Figure 2:
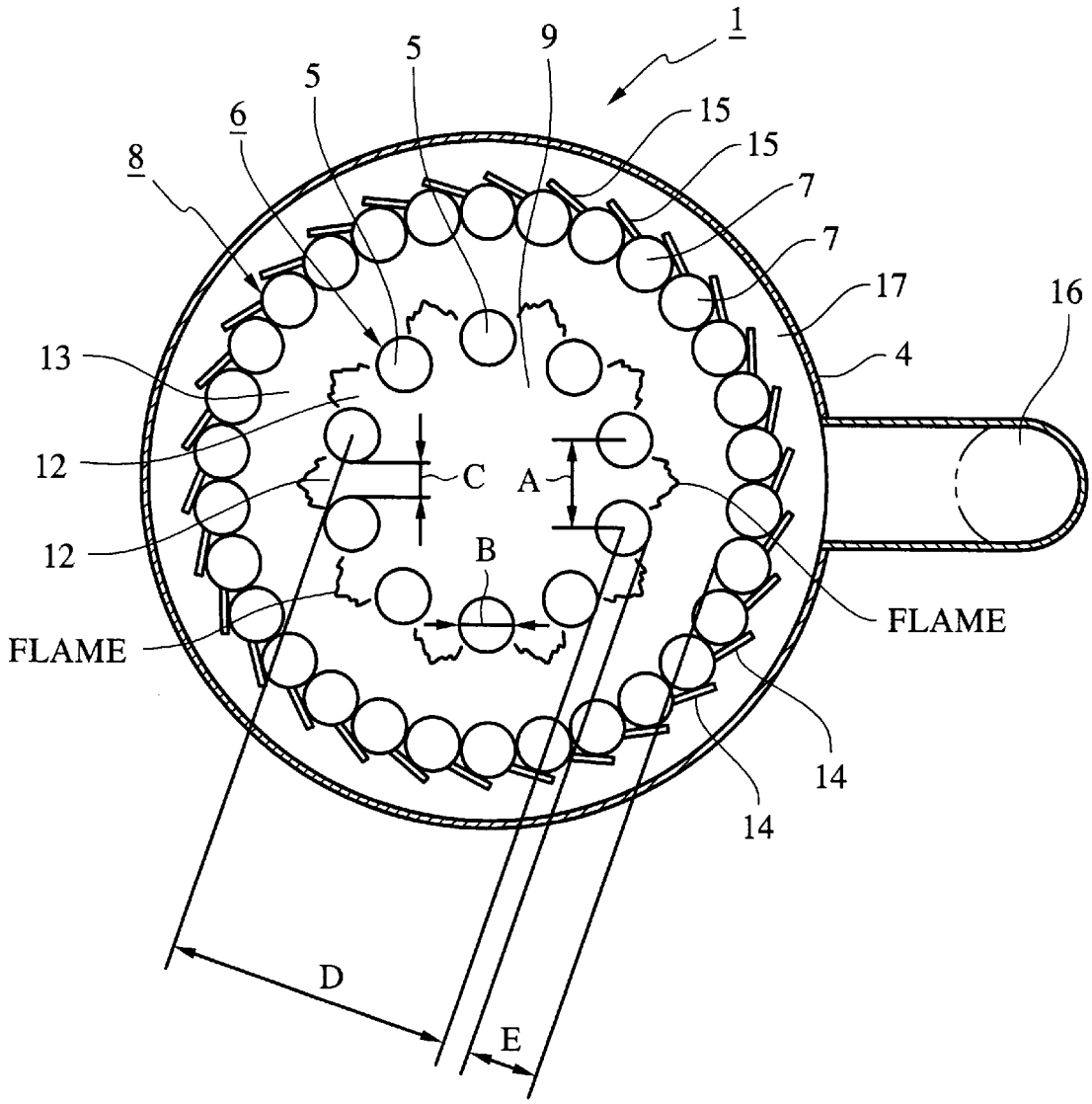
FIG. 2 is a cross section taken along the line II—II in FIG. 1.

In FIGS. 1 and 2, a boiler body 1 has an upper header 2 and a lower header 3 spaced away from each other by a specified distance. An outer wall 4 is disposed between outer circumferences of upper header 2 and lower header 3.

Between the upper header 2 and the lower header 3, a plurality o(ten in this particular embodiment) of water tubes 5 are arranged in an annular shape. These water tubes 5 constitute an annular first water tube array 6. In addition, between the upper header 2 and the lower header 3 and near the inner circumference of the outer wall 4, a plurality (thirty in this particular embodiment) of heat-recovery water tubes 7 are arranged in an annular shape to form an annular second water tube array 8. This second water tube array 8, in combination with the first water tube array 6, constitutes a double annular water tube array. The water tubes 5 and the heat-recovery water tubes 7 are connected at their respective ends to the upper header 2 and the lower header 3, respectively.

A combustion chamber 9 of the boiler is defined by the upper header 2, the lower header 3, and the second water tube array 8. Burner 10 on top of the combustion chamber 9 is fitted. Burner 10 is inserted from inside (center) of the upper header 2 toward the combustion chamber 9, so that an axis 11 of burner 10 is generally parallel to the water tubes 5 of the first water tube array 6. Burner 10 uses either liquid or gaseous fuel, selectable whichever it is. A liquid-fuel feed line 18 and a gaseous-fuel feed line 19 are connected to burner 10. Further, as means for switching the fuel, a liquid fuel valve 20 is provided on the liquid-fuel feed line 18, and a gaseous-fuel valve 21 is provided on the gaseous-fuel feed line 19.

The burner 10 causes a zone where burning-reaction ongoing gas is present, i.e., a burning reaction zone, formed in the combustion chamber 9, whereas the first water tube array 6 is located in a zone out of the burning reaction zone where a flame is present (hereinafter, referred to as "flame-present zone"). The first water tube array 6 is disposed in the burning reaction zone so that the temperature of the burning-reaction ongoing gas after contacting the water tubes 5 will be below 1400° C. Further, in the first water tube array 6, gaps 12 that allow the burning-reaction ongoing gas to flow therebetween are formed between adjacent water tubes 5.

A zone 13 where burning reactions of intermediate products (such as CO and HC and unburnt components of the fuel) are continuously effected (hereinafter, referred to as "burning-reaction continuing zone") is provided between the first water tube array 6 and the second water tube array 8. Within this burning-reaction continuing zone 13, no heat-absorbing members, such as the water tubes 5 are present.

In the second water tube array 8, gaps 14 between adjacent heat-recovery water tubes 7 (hereinafter, referred to as "second gaps") are narrow, normally from 1 to 4 mm. Further, on the outer circumferential side of the second water tube array 8, the heat-recovery water tubes 7 are each provided with a heat-transfer fin 15 (See FIG. 2).

Further, the outer wall 4 is provided with an exhaust gas outlet 16. This exhaust gas outlet 16 communicates with an annular exhaust gas flow path 17 formed between the outer wall 4 and the second water tube array 8.

In the once-through boiler as described above, when the burner 10 is activated, a burning reaction ongoing gas is formed within the combustion chamber 9. In the initial stage of the burning reaction of this burning-reaction ongoing gas, fuel decomposition occurs and then the decomposed fuel vigorously reacts with oxygen. Subsequently, intermediate products such as CO and HC generated in the burning reaction are further reacted. Thus, burning-reaction completed gas in which the burning reaction is completed, is exhausted from the boiler body 1 as exhaust gas. In the region where the burning reaction is vigorously effected, a flame occurs normally.

The burning-reaction ongoing gas flows through central part of the first water tube array 6 nearly along its axis, as the gas expands toward the lower header 3, and thus also flows into the burning-reaction continuing zone 13 through the gaps 12. Accordingly, as shown in FIG. 1, the flame forms beyond the first water tube array 6 as the burning-reaction ongoing gas flows along. This means that the water tubes 5 are located inside the flame-present zone within the burning reaction zone. Then, the burning reaction ongoing gas that causes the flame, when passing through the gaps 12, exchanges heat with heated fluid in the water tubes 5. The burning-reaction ongoing gas that causes the flame is rapidly cooled by this heat exchange. The resultant temperature decrease suppresses the generation of thermal $NO_x$. In this case, because the first water tube array 6 is an annular water tube array, the burning-reaction ongoing gas that causes the flame contacts the individual water tubes 5 uniformly, so that the thermal load on the water tubes 5 is generally uniform. Further, because this burning-reaction ongoing gas is cooled by generally uniform contact with the water tubes 5, the reduction in $NO_x$ due to the individual water tubes 5 also becomes generally uniform. Besides, as a result of this, the flame formation is lessened in this burning reaction ongoing gas.

Then, the burning-reaction ongoing gas that has passed through the gaps 12 flows into the burning-reaction continuing zone 13 toward the second water tube array 8. Until the burning-reaction ongoing gas reaches the second water tube array 8, the burning-reaction ongoing gas does not contact any heat exchanging members, like the water tubes 5, so that the temperature of the burning-reaction ongoing gas decreases minimally. Therefore, the burning-reaction ongoing gas flows through the burning-reaction continuing zone 13 while continuing to burn, while an oxidation reaction of CO into $CO_2$ is accelerated. In this burning-reaction continuing zone 13, besides the aforementioned oxidation reaction, oxidation reactions of the intermediate products, unburnt components of the fuel, and the like also occur.

The burning-reaction ongoing gas, thus becoming high-temperature gas that has completed the burning reaction before it reaches the second water tube array tube array 8, passes through the second gaps 14 into the exhaust gas flow path 17. When the burning-reaction ongoing gas passes through the second gaps 14, more heat is transferred to the heated fluid within the heat-recovery water tubes 7 by the heat-transfer fins 15. The burning-reaction completed gas flowing through the second gaps 14 and into the exhaust gas flow path 17, after transferring heat from the outside of the second water tube array 8 to the heated fluid within the heat-recovery water tubes 7, is discharged as exhaust gas through the exhaust gas outlet 16 and out of the boiler. In this case because the second water tube array 8 is an annular water tube array comprised of a plurality of heat-recovery water tubes 7, burning-reaction ongoing gas and the burning-reaction completed gas make generally uniform contact with the individual heat-recovery water tubes 7, so that heat recovery from burning-reaction ongoing gas and the burning-reaction completed gas is uniformly effected by the entire second water tube array 8. Thus, the thermal load on the heat-recovery water tubes 7 is also generally uniform in the second water tube array 8.

In the above description, the flow of burning-reaction ongoing gas is directed along the radius of the first water tube array 6. Next, the description is focused on the flow of the burning-reaction ongoing gas along the axis of the first water tube array 6. Since the burning-reaction ongoing gas flows through central part of the first water tube array 6 generally along its axis while expanding toward the lower header 3 as described above, the temperature of the burning-reaction ongoing gas decreases due to the heat transfer to the water tubes 5 which is greater downstream. Therefore, the generation of thermal $NO_x$ is suppressed. Also, because the first embodiment is a once-through boiler, heated fluid is fed from the lower header 3 to the water tubes 5 and the heat-recovery water tubes 7, ascends in the water tubes 5 and the heat-recovery water tubes 7, while being heated, and is taken out from the upper header 2 as steam.

Now the once-through boiler of this embodiment is explained in more detail. This embodiment is a once-through boiler with an evaporation rate of 500 to 4000 kg per hour. The outside diameter B of the water tubes 5 is about 60 mm. While once-through boilers normally employ water tubes 5 having an outside diameter B of about 25 to 80 mm, water-tube boilers on the whole generally employ water tubes 5 having an outside diameter B of about 20 to 100 mm. Further in this embodiment, the diameter D of the pitch circle along which the plurality of water tubes 5 are arranged as described before is about 344 mm. This diameter D needs to be at least 100 mm. That is, a smaller diameter D results in a smaller space on the inner circumferential side of the first water tube array 6, making it difficult to continue a stable burning reaction. ON the other hand, a larger diameter D results in a larger space on the inner circumferential side of the first water tube array 6, making it more likely that high-temperature regions that accelerate the generation of thermal $NO_x$ are generated inside the space. Therefore, with these considerations to this point, the upper limit of the diameter D is determined. Further, the upper limit of the diameter D depends on the required evaporation rate of the boiler. For example, for a water-tube boiler with an evaporation rate of 4000 kg/hr, the upper limit of its diameter D is 1000 mm.

Also in this embodiment, the center-to-center distance A of adjacent water tubes 5 in the first water tube array 6 is about 106 mm, and the ratio of this center-to-center distance A to the outside diameter B of the water tubes 5, A/B, is 1.8. When gaps 12 are provided between the water tubes 5 as in this embodiment, the width C of the gaps 12 is such that the burning reaction is not halted by the cooling of the burning-reaction ongoing gas by the water tubes 5. The width C of the gaps 12 in this case needs to be at least 1 mm. Accordingly, for the gaps 12 to be provided between adjacent water tubes 5, the aforementioned ration A/B is so set that $1<A/B\leqq 2$. This ratio A/B may be changed depending on the degree to which a reduction in $NO_x$ emissions is required. In terms of this, the width C of the gaps 12 in the embodiment is equal to the difference between the center-to-center distance A and the outside diameter B, being about 46 mm.

Further, the burner 10 in this embodiment has an air ratio set to 1.3, in which case the maximum temperature of the burning-reaction ongoing gas is about 1700° C. Generally, the burner for water-tube boilers maintains combustion with the air ratio set to within a range of 1.1 to 1.3, in which case the maximum temperature of burning-reaction ongoing gas is about 1800° C. for an air ratio range of 1.1 to 1.2, and about 1700° C. for another air ratio range of 1.2 to 1.3.

By setting the center-to-center distance A, the outside diameter B, and the like, of the water tubes 5 in the manner described above, the temperature of the burning-reaction ongoing gas when it passes through the gaps 12 drops to about 1100° C. by cooling because of heat exchange with the water tubes 5. At this temperature the generation of thermal $NO_x$ is largely reduced (about 1400° C.). This makes it possible to provide a once-through boiler with low $NO_x$ emissions. In addition, the amount of $NO_x$ emissions of the once-through boiler in this embodiment is about 30 ppm, as converted with 0% $O_2$. Besides, at this temperature the oxidation reaction from CO to $CO_2$ is vigorously effected (about 800° C.). This causes the oxidation reaction of CO to $CO_2$ to be effected vigorously when the burning-reaction ongoing gas passes through the burning-reaction continuing zone 13, making it possible to provide a once-through boiler with low CO emissions.

As seen above, in the once-through boiler of this embodiment, the temperature of burning-reaction ongoing gas that flowing from the gaps 12 of the first water tube array 6 is about 1100° C. However, the temperature should be generally within a range of 800 to 1400° C. depending on the extent to which $NO_x$ reduction and CO reduction are required. In this regard, the temperature of burning-reaction ongoing gas that flows out form the gaps 12 is preferably as low as possible in terms of the $NO_x$ reduction, while it is preferably as high as possible in terms of the CO reduction. From this point of view, the temperature is preferably within a range of 900 to 1300° C.

Further, in this embodiment, the radial interval E between the first water tube array 6 and the second water tube array 8 is the width of the burning-reaction continuing zone 13. The interval E is about 84 mm, 1.4 times larger than the outside diameter B. By setting the interval E in this way, the residence time of burning-reaction ongoing gas within the burning-reaction continuing zone 13 is about 47 milliseconds. In this case the corresponding amount of CO emissions is about 15 ppm. That is, in order to ensure the aforementioned oxidation reaction, the burning-reaction ongoing gas needs to be kept above a certain temperature (about 800° C.) for at least a certain reaction time at the same time. The reaction time required becomes shorter with higher temperatures of the burning-reaction ongoing gas, while the reaction time required becomes longer with lower temperatures of the burning-reaction ongoing gas. Therefore, the set value of the interval E changes depending on the temperature of the burning-reaction ongoing gas that flows out from the gaps 12, by which the residence time of the burning-reaction continuing zone 13 is adjusted. Besides, the interval E is changed depending on the number and width C of he gaps 12. The lower limit for this residence time is from 1 to 10 milliseconds. As a result, the lower lift of the interval E is about 0.5 times as large as the outside diameter B. Although a somewhat longer set value for the residence time is advantageous in terms of CO reduction, but is determined depending on the degree to which the CO reduction and the boiler downsizing are demanded. In this case, the upper limit of the interval E is preferably six times as large as the outside diameter B.

Figure 3:
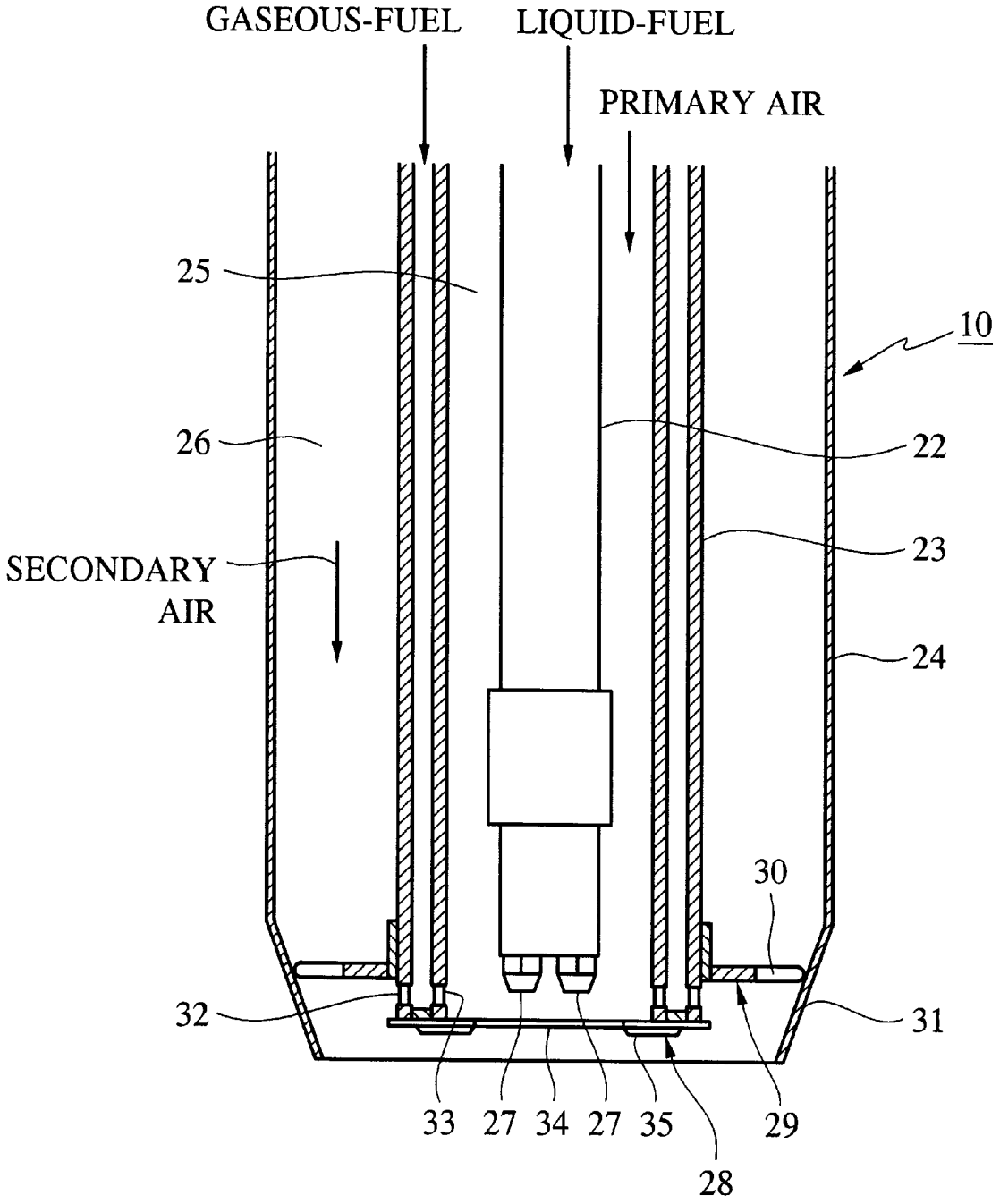
FIG. 3 is a vertical cross section of an embodiment of the burner according to the present invention.
Figure 4:
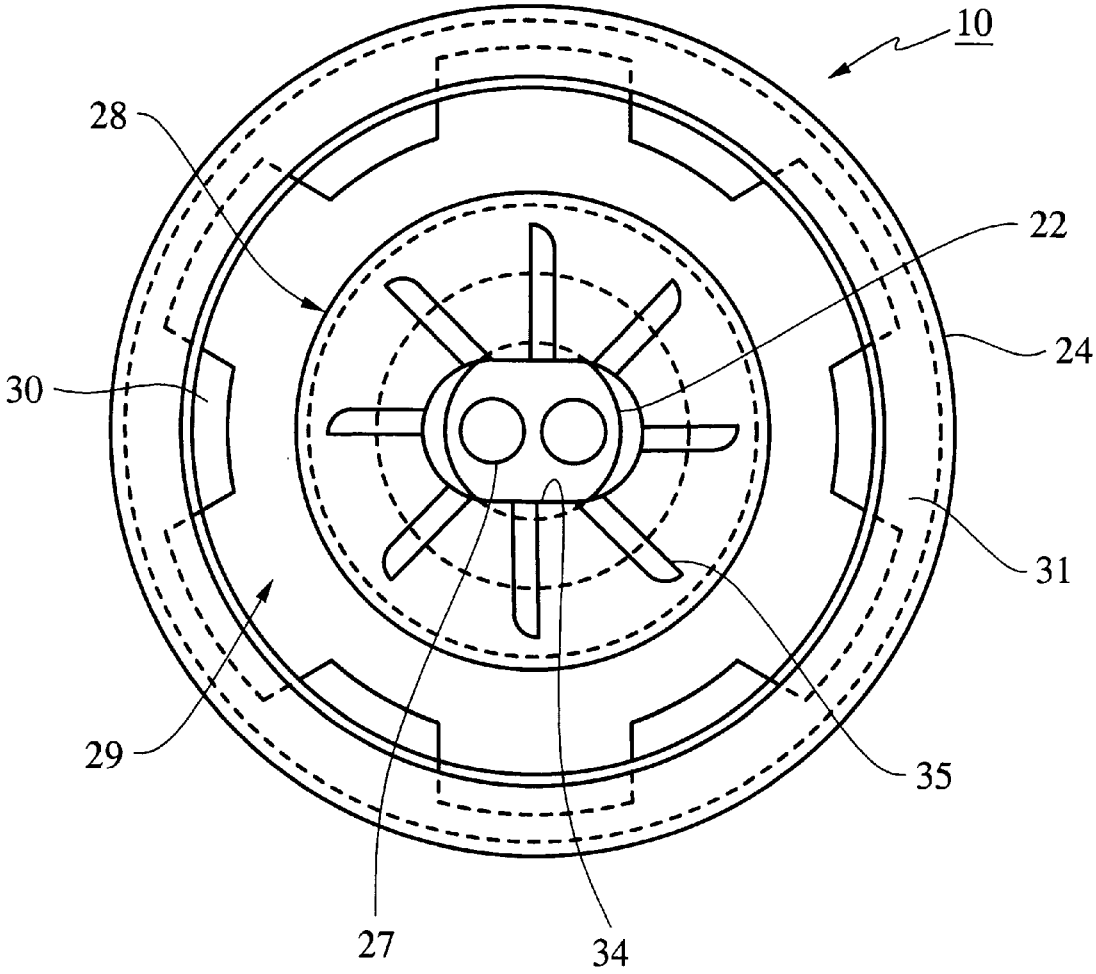
FIG. 4 illustrates the bottom surface of the burner of FIG. 3.

Next, an embodiment of the burner of the present invention is described with reference to FIGS. 3 and 4. FIG. 3 is a vertical cross section of an embodiment of the burner according to the present invention, and FIG. 4 is a view of the bottom surface of the burner of FIG. 3.

The burner 10 has a liquid-fuel nozzle pipe 22 in its center. A gaseous-fuel feed pipe 23 having a flow path with a generally annular-shaped cross section, as well as a cylindrical air resister 24 are arranged coaxially around the nozzle pipe 22. A first air flow path 25 through which primary air flows is formed between the nozzle pipe 22 and the gaseous-fuel feed pipe 23, and a second air flow path 26 through which secondary air flows is formed between the gaseous-fuel feed pipe 23 and the air resistor 24. The primary and secondary combustion air is fed by air blowers (now shown). The ratio of the primary air to the secondary air is 10 to 20% of primary air to 90 to 80% of secondary air. The liquid fuel and the gaseous fuel are fed selectively switchably.

At an end of the nozzle pipe 22, two nozzle tips 27 for spouting liquid fuel are provided. Liquid fuel is spouted from both nozzle tips 27 in he high combustion mode, and liquid fuel is spouted from only one nozzle tip 27 I the low combustion mode. At the end of the first air flow path 25, (i.e., at a position downstream of the nozzle tips 27), a first baffle plate 27 is provided. This first baffle plate 27 has an opening 34 in its center, and six swirl vanes 35 therearound. At the end of the second air flow path 26, a second baffle plate 29 is provided. This second baffle plate 29 has six cutout portions 30 circumferentially and generally equidistantly spaced in its outer peripheral portion. The secondary air flows through these cutout portions 30 (flow rate: 30–50 m/s). The secondary air is divided by these cutout portions 30 and fed as such to the fuel, by which divided flames are formed, thus allowing the reduction in $NO_x$ to be realized.

The taper portion 31 is formed at the end of the air resister 24. The taper angle is about 20°. With this structure, the flow of the secondary air is directed toward the center of the burner 10, so that the mixing of the secondary air and the fuel is facilitated, thus allowing the reduction in the CO to be realized.

The second baffle plate 29 is disposed at an axial midpoint of the taper portion 31. This arrangement makes it possible to divide the secondary air that has been put into the flow directed toward the center of the burner 10 by the taper portion 31, so that the secondary air can be divided without causing any loss of the flow of second air toward the center. Also, the distance between the second baffle plate 29 and the end of the burner 10 is minimized to reduce the residence time of burning-reaction ongoing gas downstream of the second baffle plate 29, thereby preventing the gas temperature from increasing because of the radiant heat from the flames. As a result of this, an increase in the flame temperature is prevented thus making it possible to realize the reduction in $NO_x$.

At the end of the gaseous-fuel feed pipe 23, an outer nozzle 32 for spouting gaseous fuel radially outward and an inner nozzle 33 for s pouting gaseous fuel radially inward are provided. A plurality of outer nozzles 32 and inner nozzles 33 are provided circumferentially about gaseous-fuel feed pipe 23, where the opening area of the outer nozzle 32 is larger than the opening area of the inner nozzle 33. Because the outer nozzle 32 is provided at a portion downstream of the second baffle plate 29, gaseous fuel does not need to be fed with high pressure but may be fed with low pressure. Also, the gaseous fuel spouted from the inner nozzle 33 mixes with the primary air to form a small flame at a position downstream of the first baffle plate 28. This small flame serves as a pilot flame, improving the stability of the flame.

The operation of the burner 10 is explained. In the case where liquid fuel is fed, the liquid fuel is spouted form the ends of the nozzle tips 27, first mixing with the primary air derived from the first air flow path 25 and then with the secondary air derived from the second air flow path 26, by which a flame is formed at a position downstream of the first baffle plate 28. The secondary air is fed as it is divided by the second baffle plate 29, so that divisional flames are formed, thus making it possible to realize the reduction in $NO_x$. Also, because o the taper portion 31 of the air resister 24, the mixing of the secondary air and the liquid fuel is facilitated making it possible to achieve the reduction in CO.

In the case where gaseous fuel is fed, on the other hand, the gaseous fuel is spouted from the outer nozzle 32 and the inner nozzle 33. The gaseous fuel spouted from the inner nozzle 33 mixes with the primary air derived from the first air flow path 25, thereby forming a small flame at a position downstream of the first baffle plate 28. This small flame serves as a pilot flame, improving the flame retainability. The gaseous fuel spouted from the outer nozzle 32 mixes with the secondary air derived from the second air flow path 26, forming a large flame at a position downstream of the second baffle plate 29. The secondary air is fed as it is divided by the second baffle plate 29, by which divisional flames are formed, allowing the reduction in $NO_x$ to be realized. Also, by the effect of the taper portion 31 of the air resister 24, the mixing of the secondary air and the gaseous fuel is facilitated, making it possible to achieve the reduction in CO.

The burner 10 is capable of even further reduction in both $NO_x$ and CO, when adopted as a burner for the aforementioned once-through boiler, by virtue of the effects of reduction in both $NO_x$ and CO in the boiler's body structure and the burner 10. Also, because the burner 10 uses liquid fuel or gaseous fuel selectively and switchably, the burner 10 can continue to operate by switching from one fuel to the other, even when the feed of the one fuel is disabled by some change in the fuel fee. For example, even if some disaster, accident or the like interrupts the gaseous-fuel feed network, the burner 10 can continue to operate with liquid fuel.

As described above, according to the present invention, it is possible to provide a water-tube boiler as well as a burner which can achieve even reduction in $NO_x$ in both the combustion of liquid fuel and the combustion of gaseous fuel, while attaining a reduction in both $NO_x$ and CO at the same time, and therefore which are of clean exhaust gas favorable in terms of environmental issues.

What is claimed is:

1. A water-tube boiler comprising:

a burner constructed and arranged to selectively use one of only a gaseous fuel and only a liquid fuel; and a plurality of water tubes arranged in an annular shape in a zone in the boiler where a burning-reaction ongoing gas derived from said burner is present;

wherein said burner comprises:

a liquid-fuel nozzle pipe;

an annular gaseous-fuel feed pipe arranged about said liquid-fuel nozzle pipe; and a first annular air flow path defined between said liquid-fuel nozzle pipe and said gaseous-fuel feed pipe.

2. The water-tube boiler according to claim 1, wherein said burner is a diffusion-combustion burner.

3. The water-tube boiler according to claim 1, wherein said burner comprises:

an air resister arranged around said liquid-fuel nozzle pipe;

an annular second air flow path formed between said gaseous-fuel feed pipe and said air resister;

a first baffle plate provided at an end of said first air flow path; and a second baffle plate provided at an end of said second air flow path.

4. The water-tube boiler according to claim 3, wherein said burner comprises a liquid-fuel nozzle pipe having a plurality of nozzles on an end thereof, said burner being constructed and arranged such that liquid fuel is sprayed from a selective number of said plurality of nozzles.

5. The water-tube boiler according to claim 3, wherein said burner comprises an outer nozzle constructed and arranged to spout gaseous fuel outwardly, and an inner nozzle for spouting gaseous fuel inwardly, both said outer nozzle and said inner nozzle being provided at an end portion of said gaseous-fuel feed pipe.

6. The water-tube boiler according to claim 3, wherein said first baffle plate includes a plurality of swirl vanes disposed thereabout.

7. The water-tube boiler according to claim 3, wherein a tapered portion is provided at an end of said air resister.

8. The water-tube boiler according to claim 7, wherein said second baffle plate is disposed at a mid point of said tapered portion along an axial direction thereof.

9. The water-tube boiler according to claim 1, wherein said burner includes separate gaseous-fuel and liquid-fuel feed lines, each having respective valves.

10. A water-tube boiler comprising:

a burner constructed and arranged to selectively use one of only a gaseous fuel and only a liquid fuel; and a first water tube array comprising a plurality of water tubes arranged in an annular shape in a zone in the boiler where a burning-reaction ongoing gas derived from said burner is present, wherein gaps are provided between at least some of said water tubes for allowing the burning-reaction ongoing gas to pass therethrough, wherein a zone is provided radially outward of said first water tube array wherein a burning reaction is maintained, wherein said burner comprises:

a liquid-fuel nozzle pipe;

an annular gaseous-fuel feed pipe arranged about said liquid-fuel nozzle pipe; and a first annular air flow path defined between said liquid-fuel nozzle pipe and said gaseous-fuel feed pipe.

11. The water-tube boiler according to claim 10, wherein said burner comprises:

a cylindrical air resister arranged coaxially around said liquid-fuel nozzle pipe;

wherein a second annular air flow path is defined between said gaseous-fuel feed pipe and said air resister;

wherein said burner includes a first baffle plate provided at an end of said first air flow path and a second baffle plate provided at an end of said second air flow path.

12. The water-tube boiler according to claim 11, wherein a tapered portion is provided at an end of said air resister.

13. The water-tube boiler according to claim 12, wherein said second baffle plate is disposed at a mid point of said tapered portion along an axial direction thereof.

14. The water-tube boiler according to claim 13, wherein said second baffle plate includes a plurality of circumferentially spaced apart openings therein.

15. The water-tube boiler according to claim 11, wherein said burner comprises an outer nozzle constructed and arranged to spout gaseous fuel outwardly, and an inner nozzle for spouting gaseous fuel inwardly, both said outer nozzle and said inner nozzle being provided at an end portion of said gaseous-fuel feed pipe.

16. The water-tube boiler according to claim 11, wherein said burner comprises a liquid-fuel nozzle pipe having a plurality of nozzles on an end thereof, said burner being constructed and arranged such that liquid fuel is sprayed from a selective number of said plurality of nozzles.

17. The water-tube boiler according to claim 11, wherein said first baffle plate includes a plurality of swirl vanes disposed thereabout.

18. The water-tube boiler according to claim 10, wherein said burner includes separate gaseous-fuel and liquid-fuel feed lines, each having respective valves.

19. A water-tube boiler comprising:

a burner constructed and arranged to selectively use one of only a gaseous fuel and only a liquid fuel; and a plurality of water tubes arranged in an annular shape in a zone in the boiler where a burning-reaction ongoing gas derived from said burner is present;

wherein said burner comprises a liquid-fuel nozzle pipe having a plurality of nozzles on an end thereof, said burner being constructed and arranged such that liquid fuel is sprayed from a selective number of said plurality of nozzles.

20. A water-tube boiler comprising:

a burner constructed and arranged to selectively use one of only a gaseous fuel and only a liquid fuel; and a first water tube array comprising a plurality of water tubes arranged in an annular shape in a zone in the boiler where a burning-reaction ongoing gas derived from said burner is present, wherein gaps are provided between at least some of said water tubes for allowing the burning-reaction ongoing gas to pass therethrough, wherein a zone is provided radially outward of said first water tube array wherein a burning reaction is maintained, wherein said burner comprises a liquid-fuel nozzle pipe having a plurality of nozzles on an end thereof, said burner being constructed and arranged such that liquid fuel is sprayed from a selective number of said plurality of nozzles.

* * * * *